US008262365B2

(12) United States Patent
Mathijssen et al.

(10) Patent No.: US 8,262,365 B2
(45) Date of Patent: Sep. 11, 2012

(54) METHOD FOR OPERATION OF A COMPRESSOR UNIT, AND ASSOCIATED COMPRESSOR UNIT

(75) Inventors: Gaston Mathijssen, Borne (NL); Mark van Aarsen, Hengelo (NL)

(73) Assignee: Siemens Aktiengesellschaft, München (DE)

( * ) Notice: Subject to any disclaimer, the term of this patent is extended or adjusted under 35 U.S.C. 154(b) by 784 days.

(21) Appl. No.: 12/225,251

(22) PCT Filed: Mar. 22, 2007

(86) PCT No.: PCT/EP2007/052755

§ 371 (c)(1),
(2), (4) Date: May 20, 2009

(87) PCT Pub. No.: WO2007/110368

PCT Pub. Date: Oct. 4, 2007

(65) Prior Publication Data

US 2009/0311108 A1 Dec. 17, 2009

(30) Foreign Application Priority Data

Mar. 24, 2006 (EP) ..... 06006071

(51) Int. Cl.
*F04B 43/12* (2006.01)

(52) U.S. Cl. ..... 417/53; 418/55.5

(58) Field of Classification Search ..... 417/53; 418/55.5, 55.1, 55.6, 57

See application file for complete search history.

(56) References Cited

U.S. PATENT DOCUMENTS

| | | | | |
|---|---|---|---|---|
| 4,768,888 | A | 9/1988 | McNaull | |
| 2004/0227124 | A1* | 11/2004 | Turcotte et al. | 252/71 |
| 2005/0142004 | A1* | 6/2005 | Appleford et al. | 417/371 |
| 2005/0268781 | A1* | 12/2005 | Cheney et al. | 95/161 |
| 2006/0153725 | A1* | 7/2006 | Koide et al. | 418/55.6 |

FOREIGN PATENT DOCUMENTS

| | | | |
|---|---|---|---|
| DE | 19623553 | A1 | 12/1997 |
| GB | 370003 | A | 3/1932 |
| WO | WO 2005003512 | A1 | 1/2005 |

* cited by examiner

*Primary Examiner* — Anne Hines

(57) ABSTRACT

The invention relates to a method for operating a compressor unit, in particular for underwater operation. The aim of the invention is to minimize the risk of gas hydrate formation during the compression process. To reduce said risk, according to the method components of the compressor unit are supplied with anti-freeze and/or anti-freeze is injected into the flow path of the conveyed medium to be compressed. The invention also discloses a compressor unit, which operates according to said method.

20 Claims, 1 Drawing Sheet

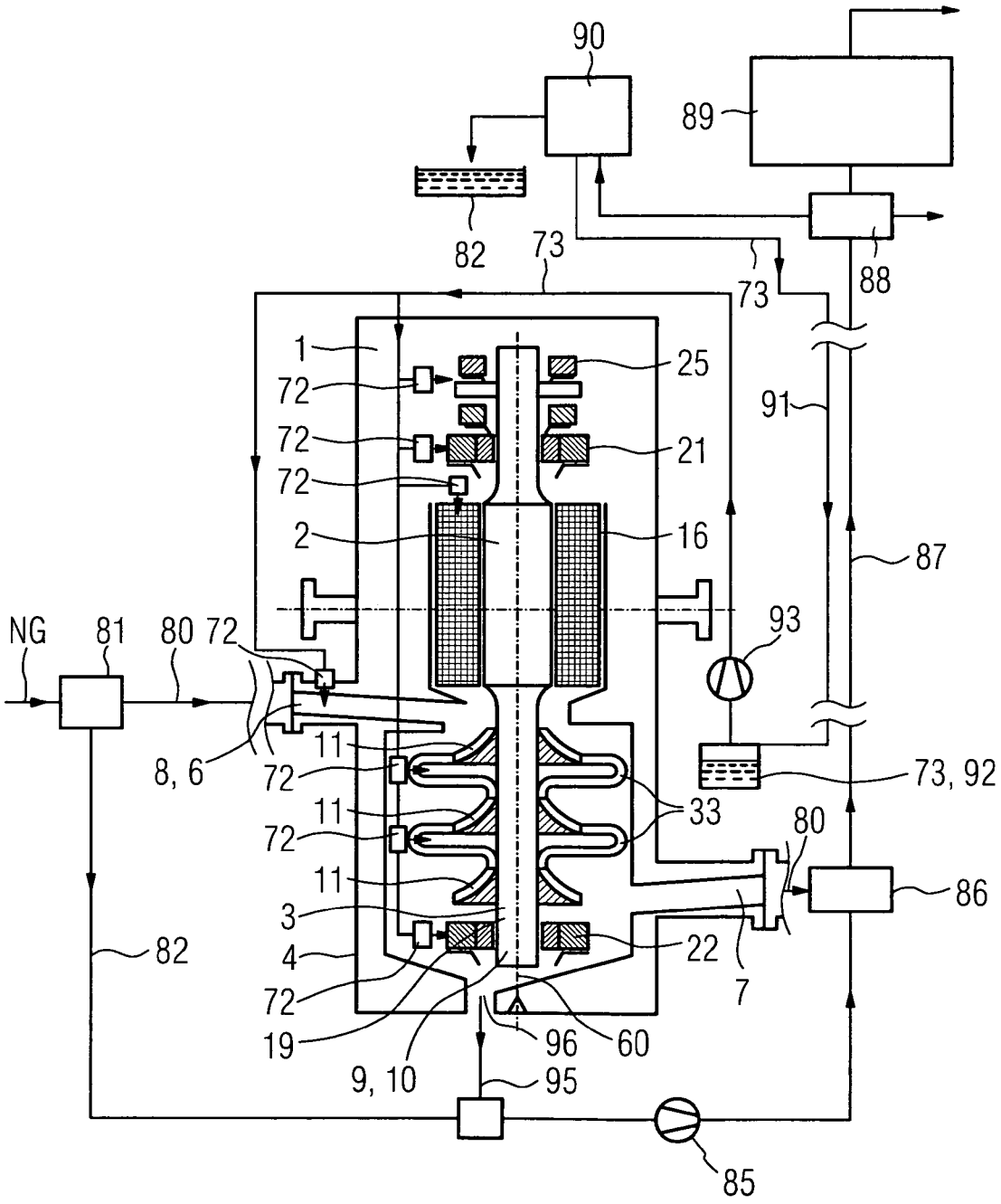
90
89
82
73
73
88
1
25
72
91
72
21
72
2
16
87
NG
81
80
72
93
8, 6
11
72
73, 92
11
33
72
80
11
86
3
82
4
22
72
7
19
96
60
9, 10
95
85

METHOD FOR OPERATION OF A COMPRESSOR UNIT, AND ASSOCIATED COMPRESSOR UNIT

CROSS REFERENCE TO RELATED APPLICATIONS

This application is the US National Stage of International Application No. PCT/EP2007/052755, filed Mar. 22, 2007 and claims the benefit thereof. The International Application claims the benefits of european application No. 06006071.2 filed Mar. 24, 2006, both of the applications are incorporated by reference herein in their entirety.

FIELD OF INVENTION

The invention relates to a method for operation of a compressor unit, in particular for underwater operation. The invention also relates to a compressor unit, in particular for underwater operation, comprising a compressor and an electric motor, which compressor unit has a housing with an inlet and an outlet for the pumping medium, with a rotation axis about which a rotor of the compressor unit can rotate.

BACKGROUND OF THE INVENTION

Recent developments in the field of compressor design have also been concentrated on undersea arrangements of large compressors which are intended to be used for the pumping of natural gases.

Because of the particular operating conditions, in particular because of the greatly restricted accessibility both for maintenance purposes and by means of supply lines, the specialists are confronted with major requirements. The relevant environmental regulations forbid any exchange of substances between the equipment to be installed and the surrounding sea water. Furthermore, sea water is an aggressive medium and extreme pressure and temperature conditions can be found at the various depths in the sea. A further requirement is that the equipment should on the one hand have an extremely long life and on the other hand must be designed to be virtually free of maintenance. An additional exacerbating factor is not-inconsiderable contamination of the medium to be pumped which in some cases is chemically aggressive.

A compressor unit of the abovementioned type has already been disclosed in international patent application WO 02/099286 A1. With the aim of simplification, without any compromises, in order to reduce the maintenance effort, and of achieving a long life at the same time, this document proposes that the compressor rotor be formed integrally with the motor rotor and be mounted at each of the ends by means of just two radial bearings.

In addition, it is known from European patent application EP 1 074 746 B1 for a turbocompressor to be equipped with three radial bearings, with the motor rotor being connected to the compressor rotor by means of a coupling.

WO 2005/003512 A1 has already disclosed a compressor unit for under-sea compression, to which an automation unit is connected by means of special connectors which are suitable for under-sea use. In addition GB 370 003 A discloses the injection of an antifreeze during the compression of air.

The compression of fluids close to the freezing point may be problematic. When natural gas is being pumped, the development relating to the formation of gas hydrates results in considerable problems. Gas hydrates are inclusion compounds which are similar to ice and in which small gas molecules, for example noble gases and various natural gas components, are surrounded in a cage of water molecules. Hydrate formation must be expected even with small amounts of liquid water and at temperatures of, for example, 10° C. The major gas catastrophe in the year 1988 on the Norwegian North Sea drilling rig Piper Alpha was supposedly due to such hydrate formation. Considerable additional operation costs are also incurred in natural gas pumping as a result of gas hydrate deposits, since they are deposited in pipelines, blocking them.

SUMMARY OF INVENTION

The invention is based on the object of providing a method for operation of a compressor, and a compressor unit, which very largely minimizes the risk of gas hydrate formation, for example when pumping natural gas under the sea.

The invention solves the problem by proposing a method for operation of a compressor unit, and a compressor unit as recited in the claims. The dependent claims, which respectively refer back to them, contain advantageous developments of the invention.

One particular advantage of the invention is the reliable protection against hydrate formation, as a result of the injection of the antifreeze. This not only allows protection of susceptible components of the compression unit but also of the entire pumping path, starting from the point at which the pumping medium is injected to the subsequent separation point. The method is also particularly advantageous because separation of undesirable additives is carried out in any case during the course of the chemical treatment of natural gases in a base station which is adjacent to the compressor unit after a pipeline. The resultant operational reliability is expressed both in higher availability of the compressor and in a high degree of safety against blocking hydrate formation in the pipeline which is connected to the compressor unit.

The antifreeze can be injected in the intake connecting stub, or directly in the compressor. Application of antifreeze to components of the compressor unit is particularly expedient for the bearings, the electric motor and other moving parts. If there is a particular risk of hydrate formation in the overflow area of individual compressor stages, antifreeze can also expediently be injected here. The primary field of application of the invention is the pumping of natural gas, since the risk of the formation of gas hydrates is relatively high here.

In particular, various alcohols make it possible to ensure protection against freezing of the gases. The injection of methyl ethylene glycol is worthwhile both for financial and technical reasons.

A somewhat more economic variant of obtaining safety against hydrate formation is to inject antifreeze at the critical points in the compressor unit before the compressor unit is started, in particular at the points mentioned above. One advantageous development of the invention provides that an amount of antifreeze is injected at the sensitive points in the compressor unit before each planned stop of the machine.

It is particularly expedient to use the antifreeze both before each start and before each machine stop. In the case of emergency stopping or tripping of the compressor unit, the primary factor of interest is to stop the machine as quickly as possible, so that it may generally not be possible to previously inject the antifreeze. Another possibility is to cause the antifreeze to be injected at the same time that the machine stop is initiated.

BRIEF DESCRIPTION OF THE DRAWINGS

The invention will be described in more detail in the following text using one specific exemplary embodiment and with reference to the drawings. The illustrated embodiment should be regarded only as an illustration, as an example of the invention. In the FIGURE:

FIG. 1 shows a schematic illustration of a longitudinal section through a compressor unit according to the invention and the major adjacent modules, which is operated using the method according to the invention.

DETAILED DESCRIPTION OF INVENTION

FIG. 1 shows, schematically, a section along a compressor unit 1 according to the invention which has, as major components, a motor 2 and a compressor 3 in a gas-tight housing 4. The housing 4 accommodates the motor 2 and the compressor 3. The housing 4 is provided with an inlet 6 and an outlet 7 in the area of the junction between the motor 2 and the compressor 3, with the fluid to be compressed being sucked in through the inlet 6 by means of a suction connecting stub 8, and with the compressed fluid flowing out through the outlet 7.

The compressor unit 1 is arranged vertically during operation, with a motor rotor of the motor 2 above a compressor rotor 9 of the compressor 3 being combined to form a common shaft 19 which rotates about a common vertical rotation axis 60.

The motor rotor is borne in a first radial bearing 21 at the upper end of the motor rotor.

The compressor rotor 9 is borne by means of a second radial bearing 22 in the lower position.

An axial bearing 25 is provided at the upper end of the common shaft 19, that is to say at the upper end of the motor rotor. The radial bearings and the axial bearing operate electromagnetically and are each encapsulated. In this case, the radial bearings extend around the respective bearing point of the shaft 19 in the circumferential direction and in this case are circumferential through 360° and are undivided.

The compressor 3 is in the form of a centrifugal compressor and has three compressor stages 11 which are each connected by means of an overflow 33. The pressure differences which result across the compressor stages 11 ensure that there is a thrust on the compressor rotor 9 which is transmitted on the motor rotor and is directed against the force of gravity from the entire resultant rotor comprising the compressor rotor 9 and the motor rotor, thus resulting in a very high degree of thrust matching during rated operation. This allows the axial bearing 25 to be designed to be comparatively smaller than if the rotation axis 60 were to be arranged horizontally.

The electromagnetic bearings 21, 22, 25 are cooled to the operating temperature by means of a cooling system (not illustrated in detail), with the cooling system providing a tap in an overflow 33 of the compressor 3. A portion of the pumping medium, which is preferably natural gas, is passed from the tap by means of pipelines through a filter, and is then passed through two separate pipelines to the respective outer bearing points (first radial bearing 21 and second radial bearing 22 as well as the axial bearing 25). This cooling by means of the cold pumping medium 80 saves additional supply lines.

The motor rotor is surrounded by a stator 16 which has encapsulation such that the aggressive pumping medium 80 does not damage the windings of the stator 16. The encapsulation is in this case preferably designed such that it can contribute to the full operating pressure. This is also because a separate cooling arrangement is provided for the stator, in which cooling arrangement a dedicated cooling medium circulates.

The compressor rotor 9 expediently has a compressor shaft 10 on which the individual compressor stages 11 are mounted. This can preferably be done by means of a thermal shrink fit. An interlock, for example by means of polygons, is likewise possible. Another embodiment provides for different compressor stages 11 to be welded to one another, thus resulting in an integral compressor rotor 9.

The pumping medium 80 or natural gas NG is passed from the natural reservoir first of all into a condensate separator 81, which separates condensates 82, including water, from the gaseous phase. The condensates 82 are passed into a condensate line 84, into which a downstream drain line 95 also opens, which introduces condensates that have been deposited in the compressor unit into the condensate line 84. The condensates 84 are passed from a condensate pump 85 to a mixing unit 86, in which they are mixed with the compressed natural gas NG or pumping medium 80. The resultant mixture is pumped into a pipeline 87 in the direction of a base station 89.

The compressor unit 1 has a system for distribution of antifreeze 73, comprising distribution lines 94 and injection modules 72. The antifreeze 73 is pumped from a reservoir tank 92 by means of a metering pump 93 to the various injection modules 72 on the compressor unit 1. The injection modules 72 locally apply antifreeze to the first radial bearing 21, to the axial bearing 25, to the second radial bearing 22 and to the overflows 33. A further injection module 72 is located on the intake connecting stub 8, by means of which module the antifreeze 73 is injected directly into the pumping medium 80 which is sucked in.

Part of the injected antifreeze 73 is deposited in the compressor unit 1, to be precise such that it is emitted through a drain 96 (at the "single drain point") of the compressor unit 1 into the drain line 95. The rest is pumped together with the compressed natural gas NG through the outlet 7 into the mixing unit 86. The antifreeze 73, the natural gas NG and the condensate 82 are pumped to the base station 89 at the earth's surface through the pipeline 87. Hydrate formation in the pipeline 87 is precluded because of the antifreeze 73 being carried with it. Before reaching the base station 89, a further condensate separator 88 ensures that the natural gas NG is dry, with the condensate including the antifreeze 73 being passed to a conditioner 90 in which the antifreeze 73 is separated from the rest of the condensate 82. The conditioned antifreeze 73 is passed back by means of a return line 91 along the pipeline 87 to the reservoir tank 92. The closed circuit of the antifreeze 73 ensures protection against hydrate formation on the one hand, and on the other hand compliance with the relevant environmental standards.

The invention claimed is:

1. A method for pumping natural gas with a compressor having a plurality of bearings, comprising:

operating a compressor under water; and applying antifreeze to the bearings of the compressor unit.

2. The method as claimed in claim 1, wherein the step of applying the antifreeze includes injecting antifreeze directly into the compressor of the compressor unit.

3. The method as claimed in claim 1, wherein the step of applying the antifreeze includes injecting antifreeze directly into an intake connecting stub for the natural gas.

4. The method as claimed in claim 3, wherein the step of applying the antifreeze includes applying antifreeze to a motor.

5. The method as claimed in claim 4, wherein the step of applying the antifreeze includes injecting antifreeze into an overflow between two compressor stages of the compressor of the compressor unit.

6. The method as claimed in claim 5, wherein the pumping medium is natural gas.

7. The method as claimed in claim 6, wherein the antifreeze is methyl ethylene glycol.

8. The method as claimed in claim 7, wherein the antifreeze is injected before the compressor unit is started.

9. The method as claimed in claim 8, wherein the antifreeze is added only before the compressor unit is started.

10. The method as claimed in claim 7, wherein the antifreeze is added before the compressor unit is stopped.

11. The method as claimed in claim 10, wherein the antifreeze is added only before the compressor unit is started and before it is stopped.

12. A method for pumping of natural gas with an underwater compressor, comprising:

operating the compressor under water; and minimizing gas hydrate formation while pumping natural gas under water with the compressor by injecting antifreeze into the flow path of the natural gas to be compressed.

13. The method as claimed in claim 12, wherein the antifreeze is injected directly into the compressor of the compressor unit.

14. The method as claimed in claim 12, wherein the antifreeze is injected directly into an intake connecting stub for the natural gas.

15. The method as claimed in claim 14, wherein the step of injecting the antifreeze includes applying antifreeze to bearings of the compressor.

16. The method as claimed in claim 15, wherein antifreeze is injected into an overflow between two compressor stages of the compressor of the compressor unit.

17. The method as claimed in claim 16, wherein the pumping medium is natural gas.

18. The method as claimed in claim 17, wherein the antifreeze is methyl ethylene glycol.

19. The method as claimed in claim 18, wherein the antifreeze is injected before the compressor unit is started.

20. The method as claimed in claim 19, wherein the antifreeze is added only before the compressor unit is started.

* * * * *